US011014715B2

(12) United States Patent
Kwon

(10) Patent No.: US 11,014,715 B2
(45) Date of Patent: May 25, 2021

(54) SAFETY CAP SPOUT

(71) Applicant: JOONGANG PLATEC CO.,LTD, Pyeongtaek-si (KR)

(72) Inventor: Oh-Joon Kwon, Seongnam-si (KR)

(73) Assignee: JOONGANG PLATEC CO.,LTD, Pyeongtaek-si (KR)

( * ) Notice: Subject to any disclaimer, the term of this patent is extended or adjusted under 35 U.S.C. 154(b) by 167 days.

(21) Appl. No.: 15/816,619

(22) Filed: Nov. 17, 2017

(65) Prior Publication Data

US 2018/0170626 A1 Jun. 21, 2018

(30) Foreign Application Priority Data

Dec. 19, 2016 (KR) ..... 10-2016-0173998
Jul. 25, 2017 (KR) ..... 10-2017-0093852

(51) Int. Cl.
*B65D 41/34* (2006.01)
*B65D 47/32* (2006.01)
*B65D 75/58* (2006.01)

(52) U.S. Cl.
CPC ..... *B65D 41/34* (2013.01); *B65D 41/3404* (2013.01); *B65D 47/32* (2013.01); *B65D 75/5883* (2013.01); *B65D 2213/00* (2013.01)

(58) Field of Classification Search
CPC ..... B65D 41/3404; B65D 41/3409; B65D 41/34; B65D 41/3442; B65D 41/3423; B65D 41/52; B65D 41/3428; B65D 41/32; B65D 2101/0046; B65D 2101/0053; B65D 2101/0076; B65D 2101/003; B65D 2101/0023
USPC ..... 215/46, 253, 251, 252, 250; 220/268, 220/266, 265; 222/562, 541.5, 541.6
See application file for complete search history.

(56) References Cited

U.S. PATENT DOCUMENTS

| | | | | |
|---|---|---|---|---|
| 8,443,999 | B1 * | 5/2013 | Reinders | B65D 41/34 220/303 |
| 8,528,757 | B2 * | 9/2013 | Bisio | B65D 41/3404 215/252 |
| 2008/0135513 | A1 * | 6/2008 | Umenaka | B65D 41/3409 215/252 |
| 2014/0010481 | A1 * | 1/2014 | Last | B65D 75/5883 383/5 |
| 2014/0021158 | A1 * | 1/2014 | Barron | B65D 41/3428 215/253 |

(Continued)

FOREIGN PATENT DOCUMENTS

| | | | |
|---|---|---|---|
| JP | 2015-137107 | A | 7/2015 |
| KR | 20-2010-0010247 | U | 4/2010 |

(Continued)

*Primary Examiner* — Allan D Stevens
(74) *Attorney, Agent, or Firm* — Jefferson IP Law, LLP

(57) ABSTRACT

The present invention relates to a spout for a pouch-type container in which a cap is coupled to a body fused to a pouch-type container body in a one-touch manner, and more particularly, to a spout which is applied to a safety cap and allows to accurately cut the guarantee seal and expose a cut-off state to an outside of an outer cap upon opening of the safety cap so as to achieve accurate opening and easy recognition, in which a guarantee seal is coupled to a latching protrusion of the body such that the latching protrusion is positioned on the guarantee seal and selectively latched to a plurality of latching grooves formed in the guarantee seal.

7 Claims, 21 Drawing Sheets

(56) References Cited

U.S. PATENT DOCUMENTS

| | | | | |
|---|---|---|---|---|
| 2015/0266631 | A1* | 9/2015 | Wohlgenannt | B65D 1/0246 215/44 |
| 2016/0122095 | A1* | 5/2016 | Berge | B65D 47/12 222/92 |
| 2017/0327278 | A1* | 11/2017 | Berge | B65D 41/3428 |

FOREIGN PATENT DOCUMENTS

| | | | |
|---|---|---|---|
| KR | 10-2012-0144018 | A | 6/2014 |
| KR | 10-2016-0032359 | A | 11/2016 |
| KR | 10-2016-7033523 | A | 7/2017 |

* cited by examiner

SAFETY CAP SPOUT

CROSS-REFERENCE TO RELATED APPLICATION(S)

This application claims the benefit under 35 U.S.C. § 119(a) of a Korean patent application filed on Dec. 19, 2016 in the Korean Intellectual Property Office and assigned Serial number 10-2016-0173998 and of a Korean patent application filed on Jul. 25, 2017 in the Korean Intellectual Property Office and assigned Serial number 10-2017-0093852, the entire disclosure of each of which is hereby incorporated by reference.

BACKGROUND OF THE INVENTION

1. Field of the Invention

The present invention relates to a configuration in which a safety cap is coupled to a body fused to a pouch-type container body in a one-touch manner, and more particularly, to a configuration which allows to accurately cut a guarantee seal and expose a cut-off state to an outside of an outer cap upon opening of the safety cap so as to achieve accurate opening and easy recognition.

2. Description of the Related Art

A spout for safely sealing and discharging contents is used in a typical pouch-type container. Such a spout includes: a body having a fusion-welding part, which is inserted into a predetermined position located at an upper end of the pouch-type container and fused with the pouch-type container, and an outflow hole formed at an upper end of a straw and exposed to an upper side of the fusion-welding part; and a cap detachably coupled to the straw in a typical screw-coupling manner in order to seal the outflow hole of the body.

In addition, the outflow hole of the body to which the cap is coupled may be adhered and sealed with a thin film formed of an aluminum material, or may be provided with a rib serving as a sealing device in the inside of the cap to control the outflow hole according to the application (for high temperature or low temperature sterilization).

In addition, a lower end of the cap is provided with a separate guarantee seal (also referred to as a skirt) for the purpose of temper-proof, so that if the cap is opened when the cap is coupled with the body, the guarantee seal is broken for the purpose of temper-proof.

The operation structure of the guarantee seal includes: a latching protrusion provided on the body; and a latching groove formed in the guarantee seal positioned on a lower end of the cap, wherein the guarantee seals are disposed directly under the cap, spaced apart from each other, and coupled to each other by a weak part.

Therefore, when the cap is opened, the weak part is broken as the latching protrusion is latched to the latching groove, and the guarantee seal is separated from the cap, so that a temper-proof state can be visually and easily recognized.

However, the disadvantage of the cap is that since the upper end of the cap is blocked to block the outflow hole of the body, if infants accidentally or carelessly swallow the cap, there is a risk in which the airway of the infants may be blocked.

Therefore, in recent years, a safety cap that does not block the airway even if it is swallowed by accident or carelessness has been proposed.

However, although such a safety cap does not block the airway, there is a molding problem that the guarantee seal may not be formed directly under the inner cap and may be formed only when the guarantee seal is spaced outward from a lower side of the cap. In addition, when formed as described above, the guarantee seal is obscured by the outer cap, so that the guarantee seal is not easily exposed to the outside even if it is broken. Therefore, there might be inconvenience for a user to check the temper-proof state.

In other words, the problem of airway blockage due to the cap have been solved by providing the inner cap to block the outflow hole of the body and providing the outer cap including an annular wall part that surrounds a tab such that a vent hole is formed at an outside of the inner cap by the tab. However, the problem that the guarantee seal cannot be seen because the guarantee seal is located at a lower end of the inner cap and the problem that the guarantee seal cannot be formed directly under the inner cap still remain.

In other words, as is known, most of the safety caps used for a pouch-type container, particularly those for accommodating liquid food, includes a guarantee seal. In addition, the guarantee seal includes a weak part to be broken as a result of screw-loosening the cap from the pouch-type container, so that it is possible to check whether or not the pouch-type container is opened in advance.

However, users often do not notice much of the actual condition of the guarantee seal because the guarantee seal is obscured by the outer cap constituting the safety cap.

Even if the user knows that the guarantee seal can be broken, the user has to check the appearance of the guarantee seal carefully to recognize the actual condition of the guarantee seal by frequently turning over the pouch-type container.

This means that the breakage condition of the guarantee seal may not be immediately seen to the users who only perform the checking randomly or accidentally.

Therefore, in order to ensure that the guarantee seal is directly exposed to the outside so as to be easily seen, the annular wall part of the outer cap can be formed to be short so as to expose the guarantee seal that is spaced outwards from the lower end of the inner cap. However, in this case, the design of a product is not good, and not suitable for a practical product design.

Therefore, recently, in order to solve these problems, if a pouch is opened when the guarantee seal is not exposed much at the lower end of the outer cap, the guarantee seal is folded or sagged so as to be exposed downwards as the guarantee seal is broken, so that the checking can be easily performed.

However, in such a case, since the guarantee seal cannot be positioned directly under the inner cap due to the molding problem, the guarantee seal is spaced outwards from the inner cap while being positioned under the inner cap. The latching protrusion located at the lower end of the straw provided with the outflow hole of the body is latched to the latching groove of the guarantee seal, such that the latching protrusion pushes the guarantee seal outwards from the inside, or pushes the guarantee seal upwards from a lower side. In this case, considering that the guarantee seal is connected to each other by the weak part, since the support force is weakened, the breakage due to the accurate latching may not occur.

Therefore, in most cases, additional reinforcing fins are additionally provided between the guarantee seal and the inner cap to prevent the cap from spinning without traction. In this case, a certain portion of the broken guarantee seal may not be exposed to the outside.

In addition, when it is desired to provide such reinforcing fins for support, there is a difficulty in forming a mold or in injection molding, and productivity is degraded because the flowability of an injection-molded product is not good. Accordingly, the defective rate is high, so that it is difficult to perform actual mass production.

Therefore, recently, in order to solve such a problem, the lower rim of the annular wall part constituting the outer cap is cut into a waveform having a valley and a peak, so that the guarantee seal can be easily exposed. However, this may result in a problem that a deformed shape of the outer cap may spoil the design, which may cause problems in practical use.

The above information is presented as background information only to assist with an understanding of the present disclosure. No determination has been made, and no assertion is made, as to whether any of the above might be applicable as prior art with regard to the present disclosure.

SUMMARY OF THE INVENTION

The present invention has been made to solve the above problems of the related art, thereby improving the accuracy of breakage in the latched state, and inducing a certain portion of the broken guarantee seal to be accurately exposed to the outside.

To this end, the guarantee seal is coupled to the latching protrusion of the body such that the latching protrusion is positioned on the guarantee seal and selectively latched to a plurality of latching grooves formed in the guarantee seal, thereby solving the conventional problems.

Therefore, when the cap and the body are assembled to each other, the latching protrusion slides on the upper surface of the guarantee seal, and is latched to the latching groove. If the cap is rotated in the opposite direction so as to be opened when the latching protrusion is latched, since the upper surface of the guarantee seal is gradually inclined upwards toward the latching groove, the latching protrusion slides on the upper surface of the guarantee seal and is screw-tightened so as to be latched to the latching groove. In this case, when the latching protrusion is inserted into the latching groove, the guarantee seal can be accurately broken upon opening by the latching sill that is formed by the inclination of the guarantee seal, and the guarantee seal is dropped down as the guarantee seal is accurately broken and accurately exposed. Accordingly, it is possible to be accurately coupled without spoiling the design, and it is possible to easily and accurately break the guarantee seal upon opening and to expose the broken guarantee seal downwards.

Other aspects, advantages, and salient features of the disclosure will become apparent to those skilled in the art from the following detailed description, which, taken in conjunction with the annexed drawings, discloses various embodiments of the present disclosure.

BRIEF DESCRIPTION OF THE DRAWINGS

The above and other aspects, features, and advantages of certain embodiments of the present disclosure will be more apparent from the following description taken in conjunction with the accompanying drawings, in which.

Throughout the drawings, it should be noted that like reference numbers are used to depict the same or similar elements, features, and structures.

DETAILED DESCRIPTION OF THE INVENTION

The following description with reference to the accompanying drawings is provided to assist in a comprehensive understanding of various embodiments of the present disclosure as defined by the claims and their equivalents. It includes various specific details to assist in that understanding but these are to be regarded as merely exemplary. Accordingly, those of ordinary skill in the art will recognize that various changes and modifications of the various embodiments described herein can be made without departing from the scope and spirit of the present disclosure. In addition, descriptions of well-known functions and constructions may be omitted for clarity and conciseness.

The terms and words used in the following description and claims are not limited to the bibliographical meanings, but, are merely used by the inventor to enable a clear and consistent understanding of the present disclosure. Accordingly, it should be apparent to those skilled in the art that the following description of various embodiments of the present disclosure is provided for illustration purpose only and not for the purpose of limiting the present disclosure as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

Hereinafter, the present invention will be described in detail with reference to the accompanying drawings.

Figure 1:
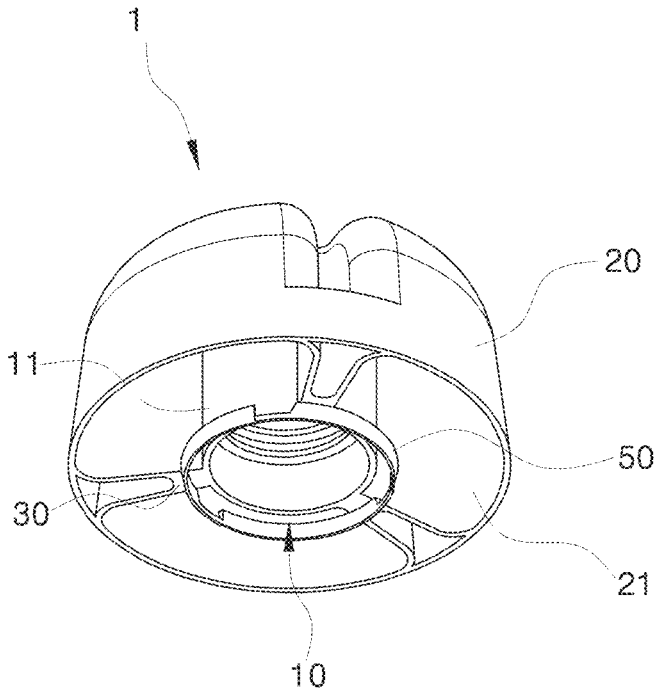
FIG. 1 is a view showing a state in which a guarantee seal is mounted on a lower end of an inner cap of a safety cap according to the present invention.
Figure 2:
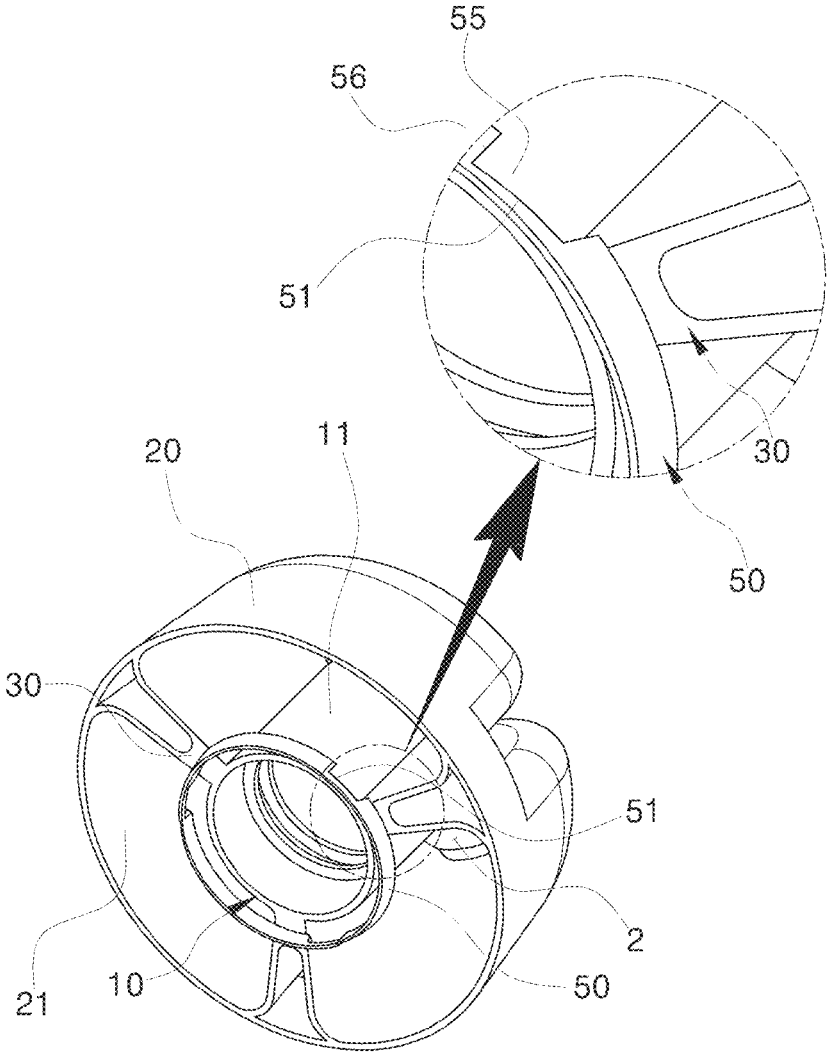
FIG. 2 is an enlarged view showing a state in which the guarantee seal is mounted on a tab according to the present invention, and includes an enlarged view of a section thereof.
Figure 3A:
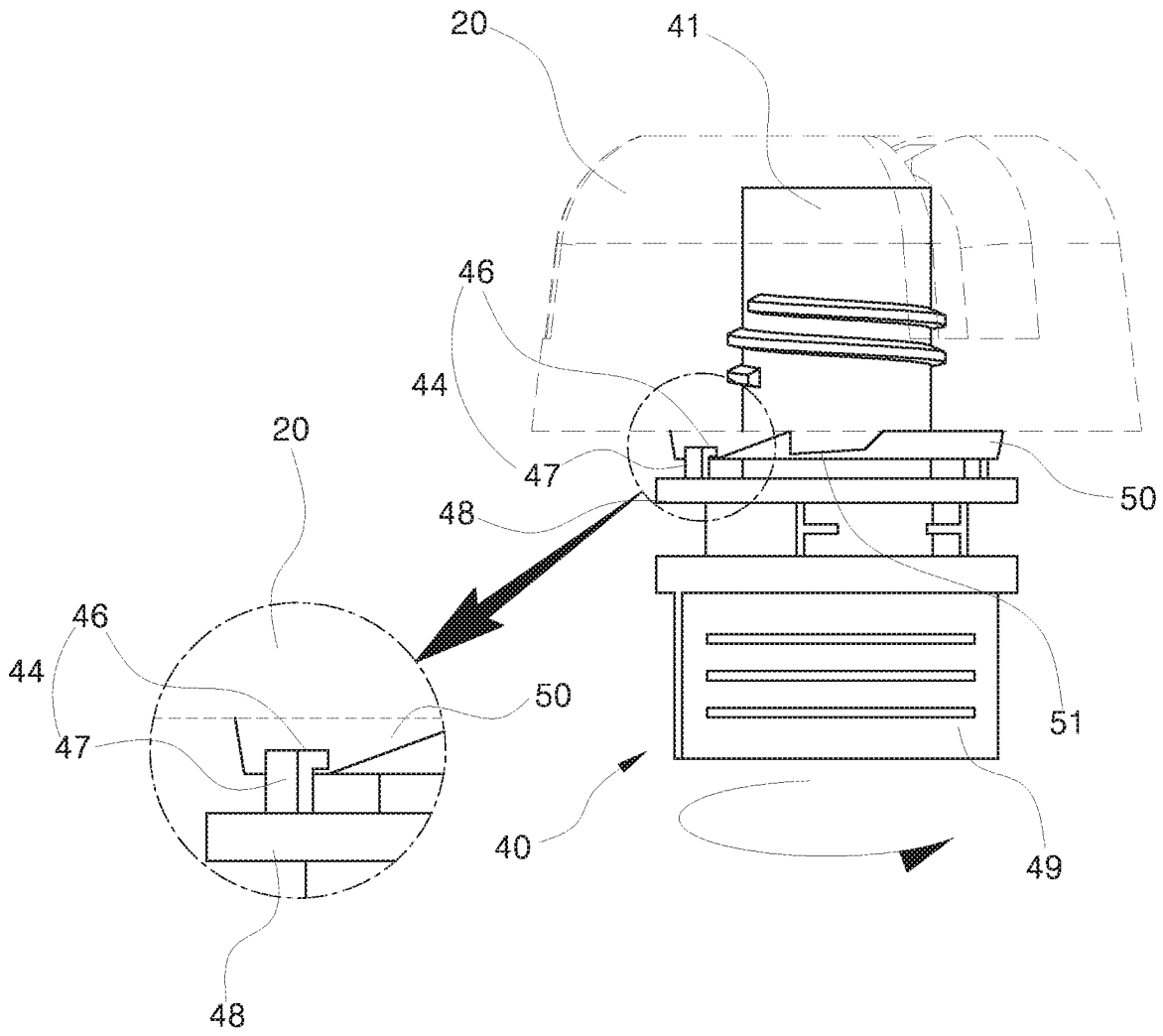
FIGS. 3A to 3C are views showing a state in which a latching protrusion of a body is seated and slides on an upper surface of the guarantee seal according to the present invention, and each of the figures includes an enlarged view of a section thereof.
Figure 3B:
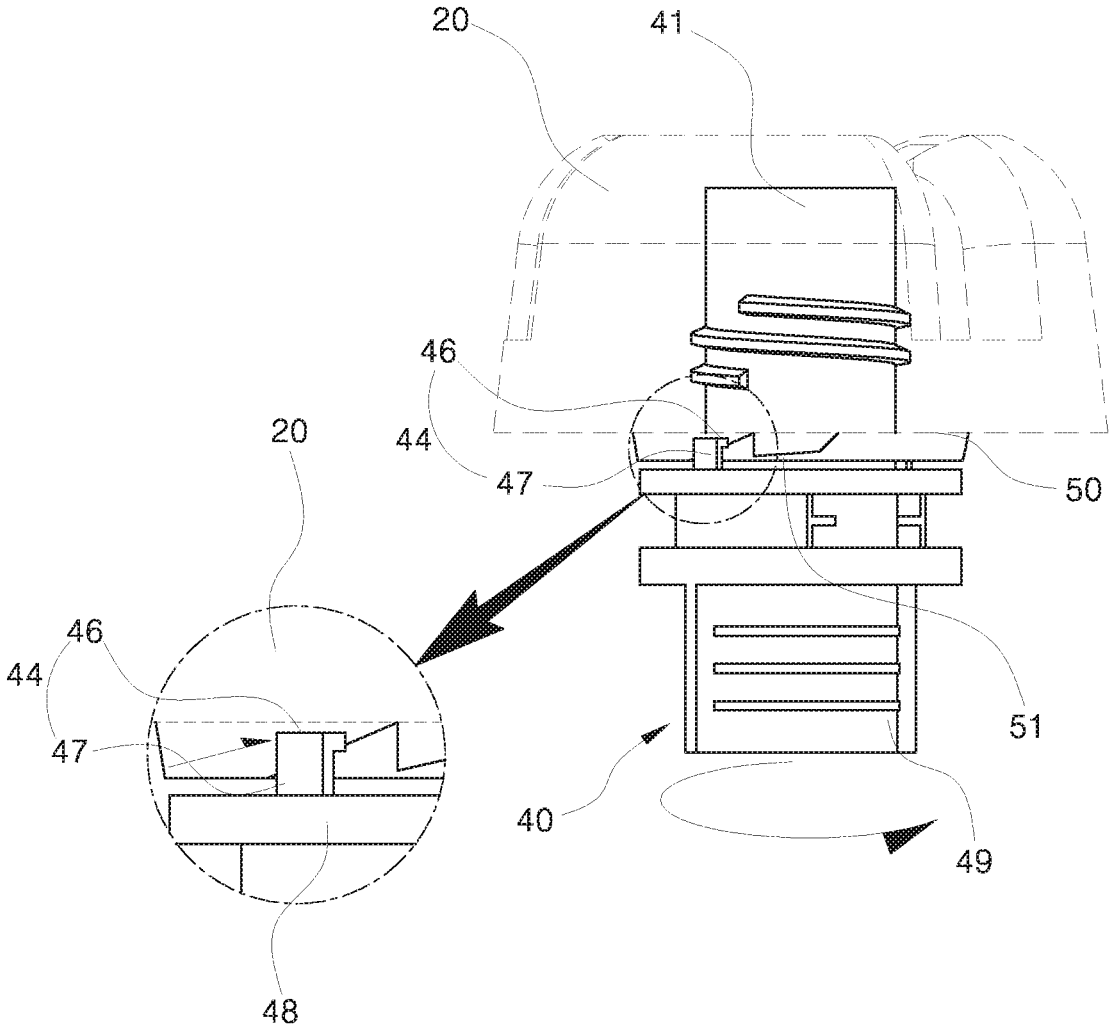
Figure 3C:
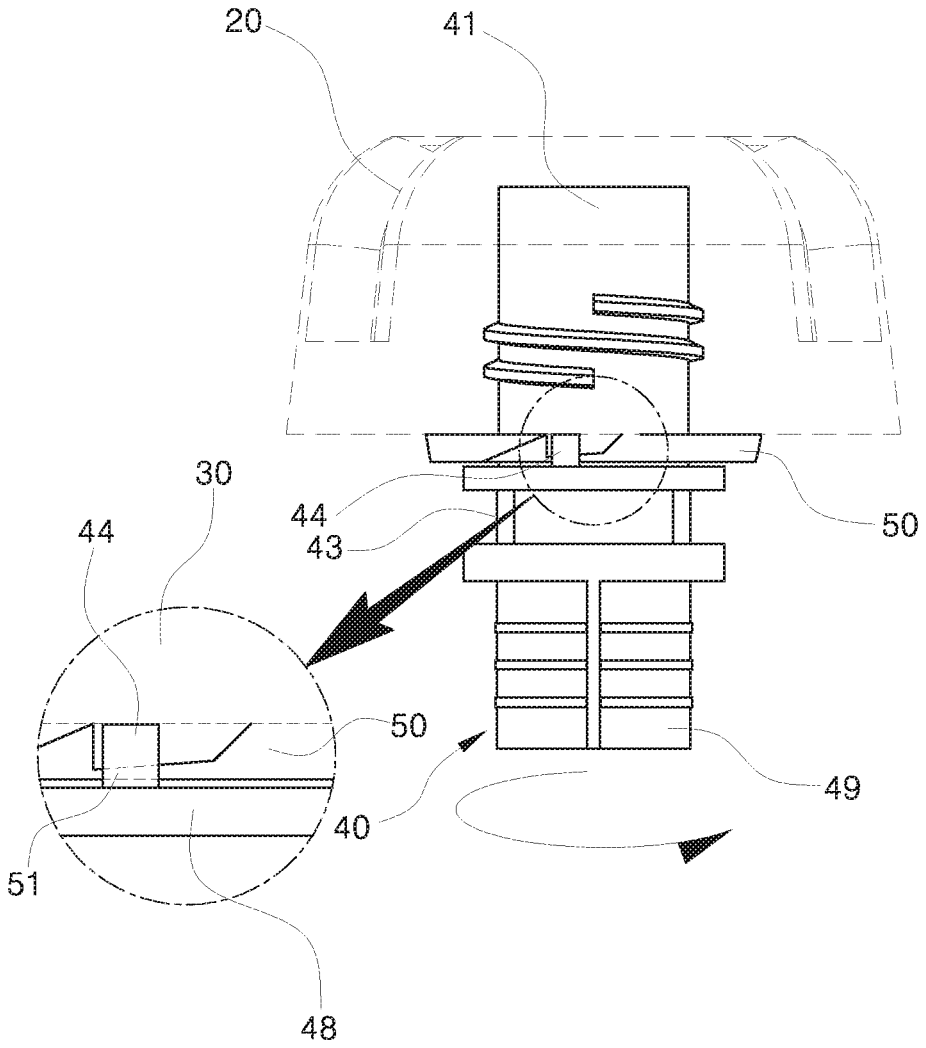
Figure 4:
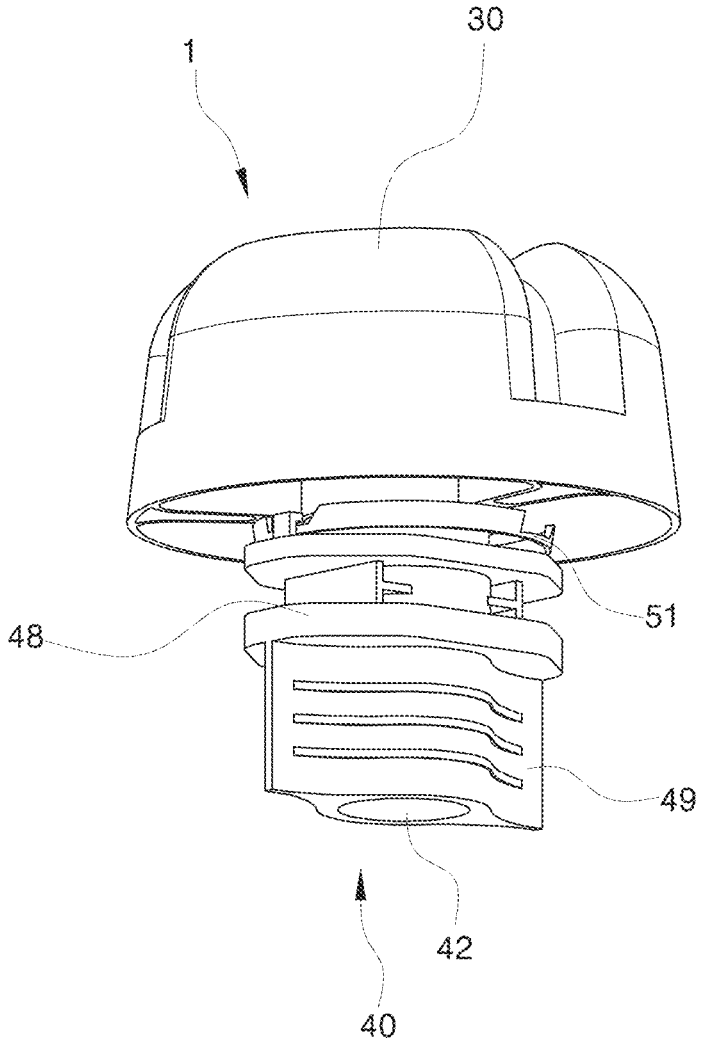
FIG. 4 is a view showing a state in which the latching protrusion is inserted into a latching groove and makes close contact with a latching sill according to the present invention.
Figure 5:
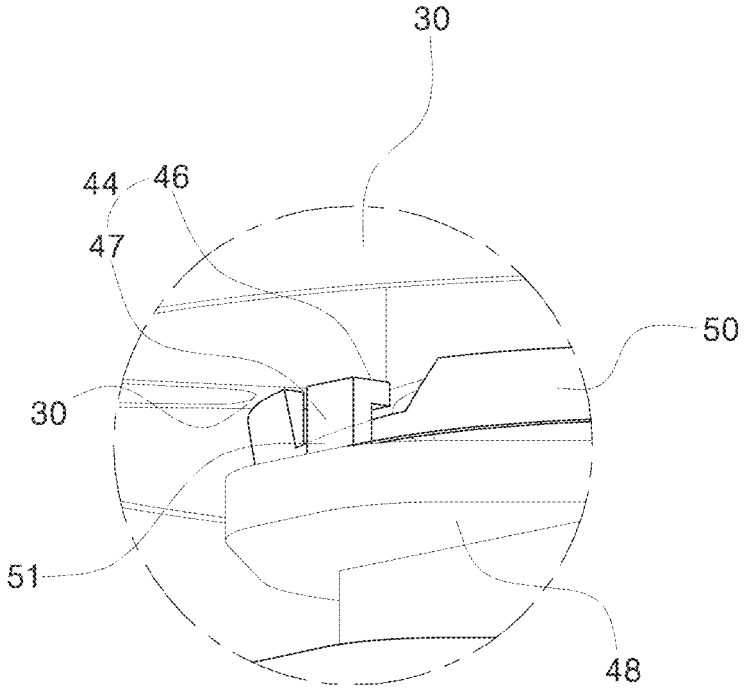
FIG. 5 is an enlarged view showing a region where the guarantee seal provided with the latching sill is broken according to the present invention.
Figure 6A:
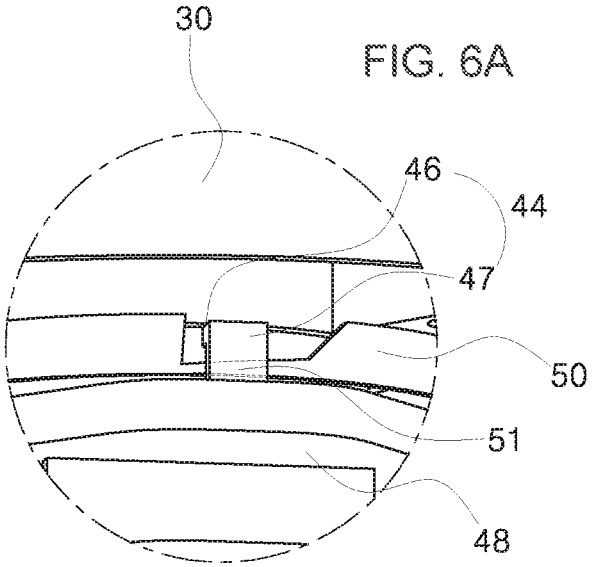
FIG. 6A is a view showing a state in which the guarantee seal is not broken and FIG. 6B is a view showing a state in which the guarantee seal is broken and exposed upon opening according to the present invention.
Figure 6B:
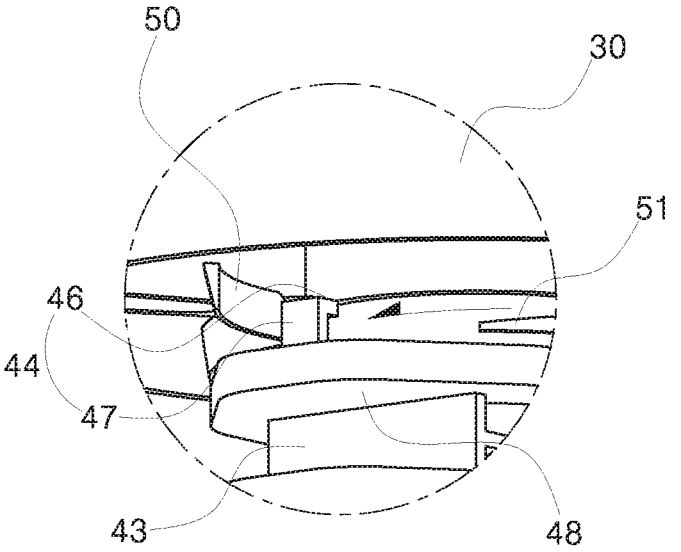
Figure 7:
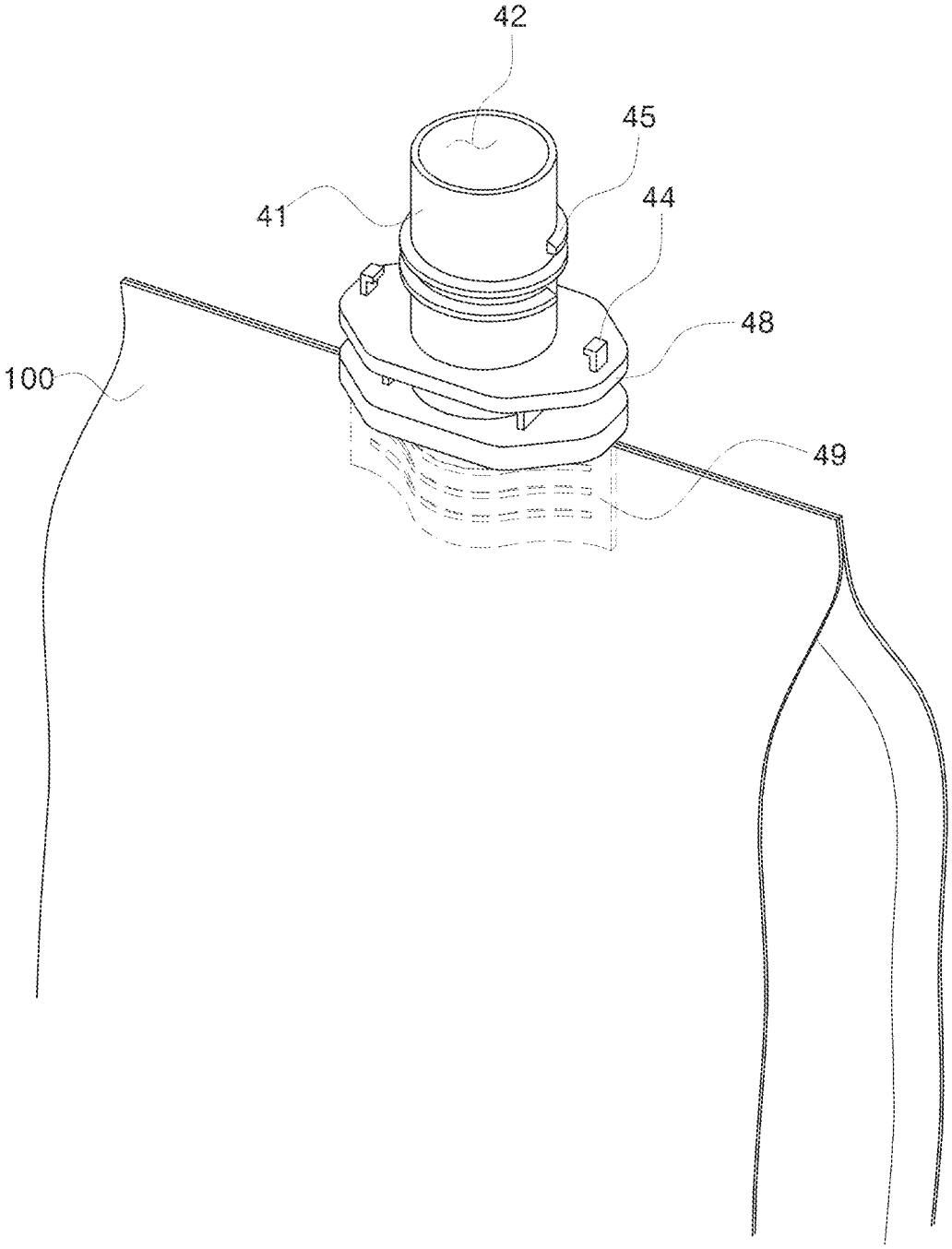
FIG. 7 is a perspective view showing a latching protrusion provided on a body according to one embodiment of the present invention.
Figure 8:
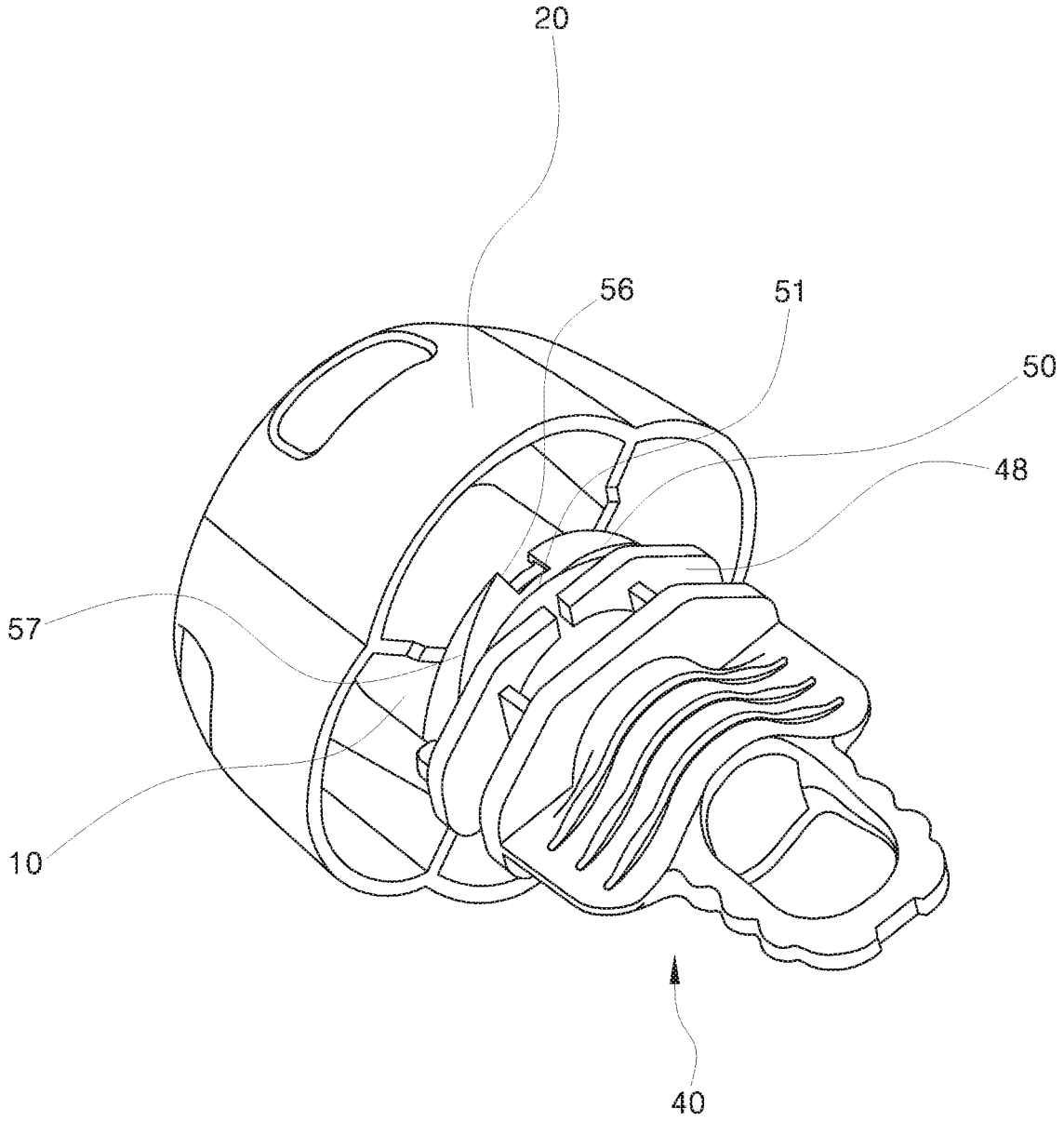
FIG. 8 is a view showing a state in which the upper surface of the guarantee seal is twisted in order to allow the latching protrusion to be positioned on the upper surface of the guarantee seal according to the present invention.
Figure 9:
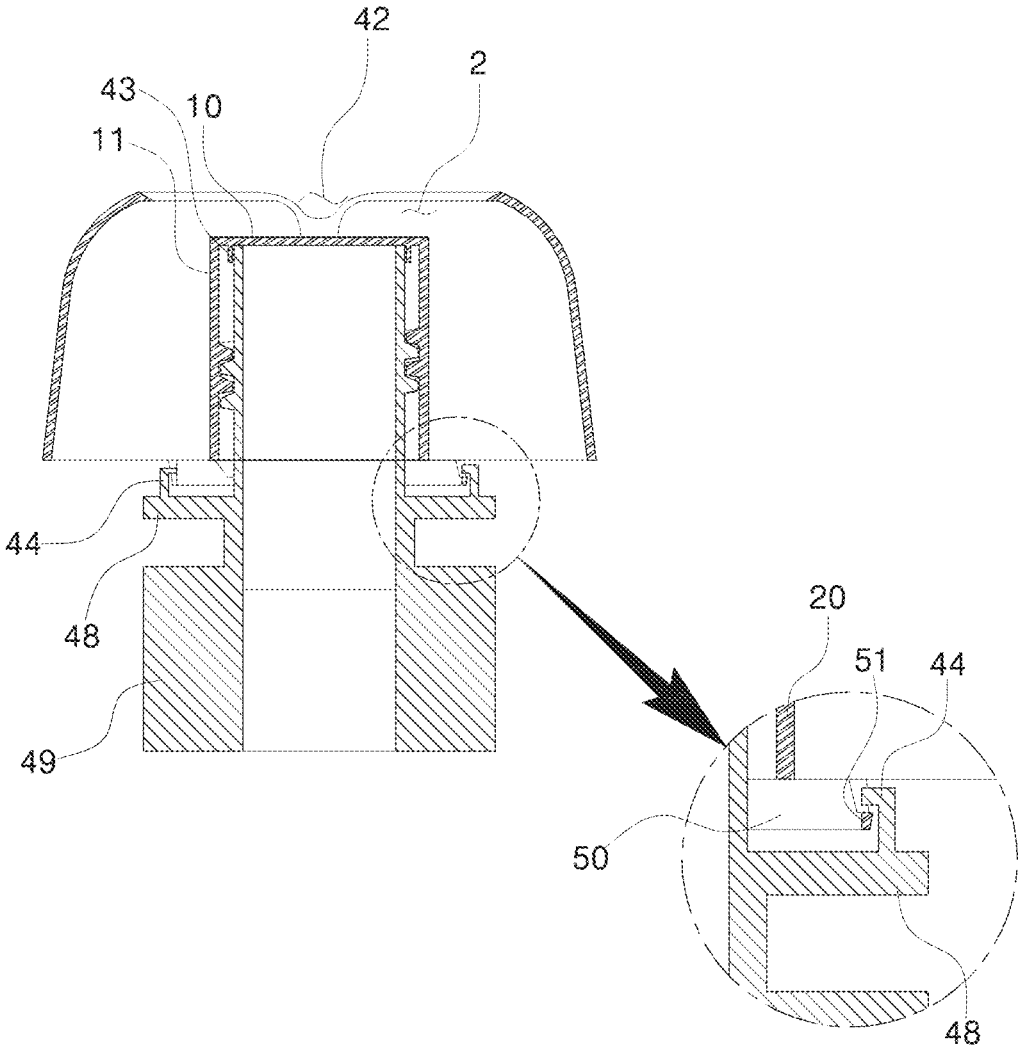
FIG. 9 is a sectional view showing a state in which the latching protrusion is inserted into the latching groove of the guarantee seal when the cap and the body are assembled to each other according to the present invention, and includes an enlarged view of a section thereof.

First, FIGS. 1 to 9 show a safety cap spout according to a first embodiment of the present invention.

Reference numeral 1 denotes a cap 1, which is preferably injection molded with plastic and can be screw-tightened and screw-loosened on a straw 41 of a body 40 fused to a pouch-type container 100, which is particularly a pouch-type container 100 for a liquid for children, such as fruit juice and various drinks.

The cap 1 includes: an inner cap 10 having a tubular body formed along a central axis X; and an outer cap 20 having an annular wall part 21 that has an inner wall connected to an outer wall of the inner cap 10 by a tab 30, wherein a vent hole 2 is formed between at least two tabs 30.

In other words, the annular wall part 21 is connected to the tab 30 while being radially spaced apart from the inner cap 10, and the vent hole 2 formed thereby and formed by the tabs 30 arranged at a predetermined interval provides a passage for allowing air to pass there through, so that choking accidents, for example, which may occur by the cap 1 by blocking an airway when a child accidentally swallows the cap 1 can be prevented.

According to the present invention, the inner cap 10 is preferably formed in a cylindrical shape, and formed on an inner side surface thereof with a threaded part 11 so as to be screw-coupled with a screw thread 45, which is formed on the straw 41 of the body 40 fused to a flexible pouch-type container 100.

An upper surface of the inner cap 10 is closed to seal an outflow hole 42 of the body 40, and the rib 43 is formed on an opposite surface of the upper surface of the inner cap 10 for sealing.

In addition, the inner cap 10 is provided at a lower end thereof with a guarantee seal 50 suitable to be broken when the cap 1 is screw-loosened from the body 40 fused to the pouch-type container 100 in a state in which the cap 1 is coupled to the body 40.

The guarantee seal 50 is located at the lower end of the inner cap 10. For injection-molding, the guarantee seal 50 is formed with an inner diameter larger than an outer diameter of the inner cap 10, positioned outside a portion directly under the inner cap 10, and provided with cut-out parts connected by a weak part 51. According to the present invention, a lower rim of the guarantee seal is connected, and an upper rim has a latching groove 55 incised to form a latching sill 56 at predetermined intervals.

If there are three tabs 30, it is preferred to form three latching grooves 55, and if there are four tabs 30, it is preferred to form four or two latching grooves 55.

In addition, the latching groove 55 is positioned such that the weak part 51 is as close as possible to a portion where the guarantee seal 50 is coupled to the tab 30 when the upper rim of the guarantee seal 50 is coupled to the lower end of the tab 30. Therefore, in a state in which the guarantee seal 50 is partitioned into the cut-out part and the latching groove 55 located between the tabs, the latching groove 55 is formed at a position biased rightwards from a center, so that the guarantee seal 50 can be easily broken and the cut-out part can be easily exposed.

In addition, when the weak part 51 extends to the latching sill 56, the latching groove 55 is sloped upward, so that the weak part 51 can be easily cut out.

The cutting is easily performed because the pressing force is transmitted as it is by the latching sill 56 when the cap 1 is screw-loosened in a state in which a latching protrusion 44 of the body 40 is latched to the latching groove 55, that is, when the cap 1 is rotated counterclockwise. When the cap 1 is screw-loosened, the broken cut-out part is pushed by the latching protrusion 44 and the guarantee seal 50 is exposed downward of the outer cap 20 as the weak part 51 of the guarantee seal 50 is broken.

In addition, the latching protrusion 44 of the body 40 engaged with the latching groove 55 of the guarantee seal 50 protrudes from a top surface of a latching flange 48 spaced upwards from a fusion-welding part 49 fused to the pouch-type container 100.

Further, when the straw 41 is coupled to the threaded part 11 of the inner cap 10 and locked, the latching protrusion 44 protruding from the top surface of the latching flange 48 of the body slides on the upper surface of the guarantee seal 50. At this time, a twisted part 57 is provided on the upper surface of the guarantee seal to allow the latching protrusion 44 to be slidable on the upper surface of the guarantee seal, so that the latching protrusion 44 can be instantaneously coupled with the latching groove 55 while pressing the upper surface of the guarantee seal downwards from an upper side.

In this case, in order to allow the latching protrusion 44 to be accurately positioned on the twisted part at the upper surface of the guarantee seal 50 when the cap 1 is screw-fastened to the body 40, the latching protrusion 44 includes an upright shaft 47 and a latching hook 46 protruding therefrom while being bent inwards.

In order to allow the latching hook 46 to be accurately latched to the latching groove 55, the upper surface of the guarantee seal is upwardly twisted toward the latching groove 55 as described above. According to the present invention, the volume of the latching hook 46 is gradually increased for the upward twist.

In other words, if there are three latching grooves 55, the upper surface of the guarantee seal is twisted toward a front end where each latching grooves 55 is formed, that is, the latching sill 56, so that the latching hook 46 of the latching protrusion can be pressed, and the twist is upwardly formed as described above.

Accordingly, when the latching hook of the latching protrusion is continuously rotated while being positioned on the upper surface of the guarantee seal upon the screw-fastening, the latching hook is rotated while pressing the upper surface and accurately seated in the latching groove, so that the latching hook is latched to the latching groove.

When screw-loosened to open the cap, since the front end of the latching groove of the guarantee seal is inclined upwards, and the weak part inclined upwards and coupled to the tap is located directly rearward of the latching sill, the weak part is easily and accurately broken if a pressing force is generated at the latching sill, and one end of the broken guarantee seal, that is, the cut-out part is pushed by the latching hook, so that the damaged guarantee seal can be hung down and exposed downward of the outer cap.

Figure 10:
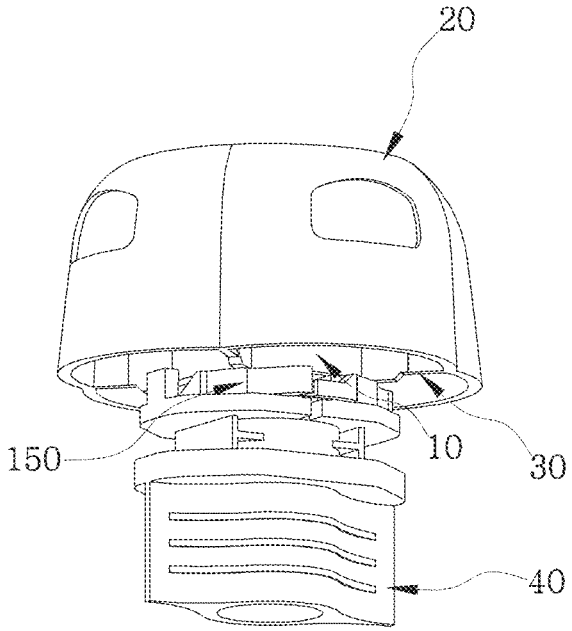
FIG. 10 is a perspective view showing a safety cap coupled to a body according to a second embodiment of the present invention.
Figure 11:
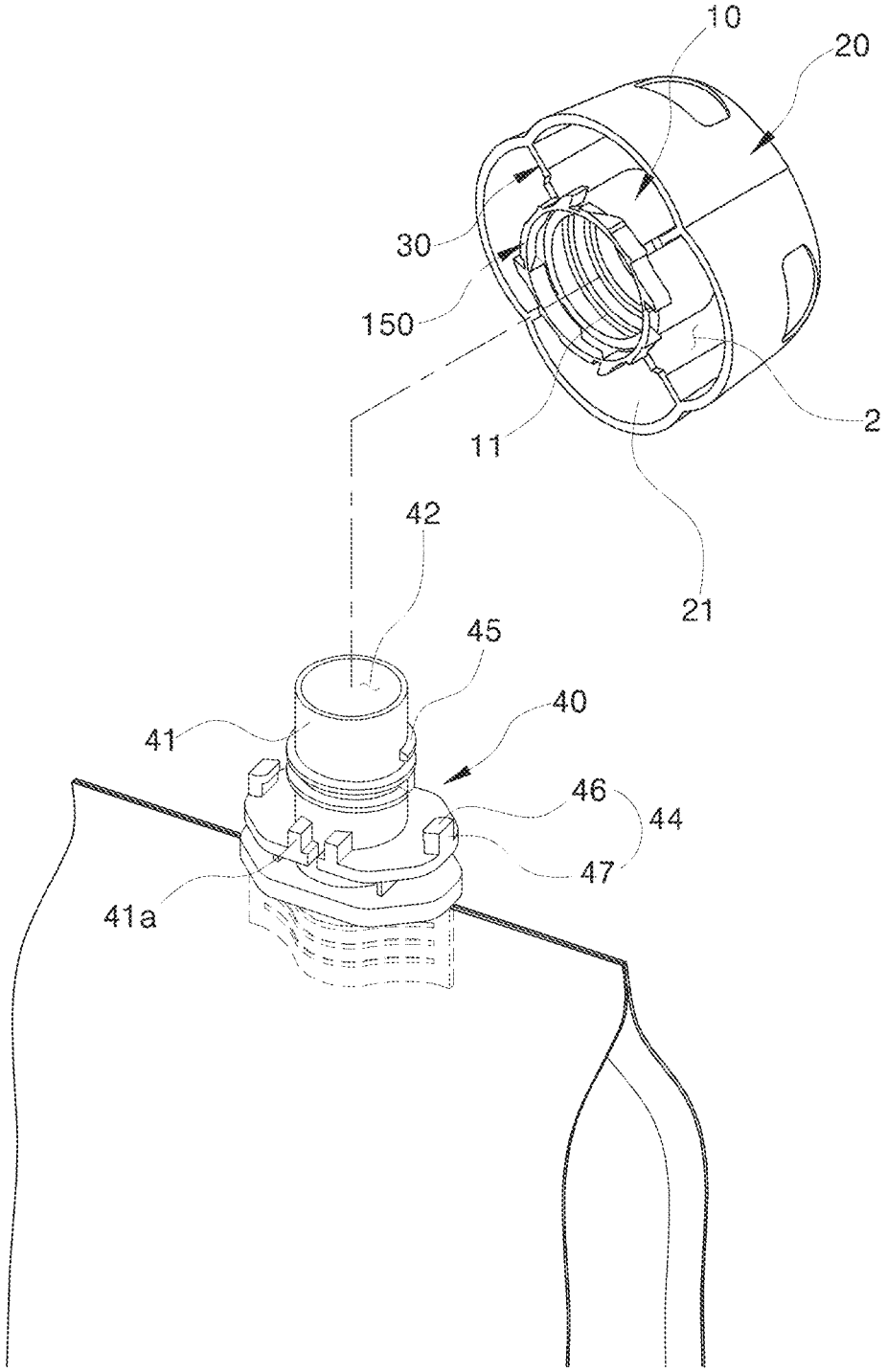
FIG. 11 is a view showing a state of using the safety cap coupled to the body according to the second embodiment of the present invention.
Figure 12:
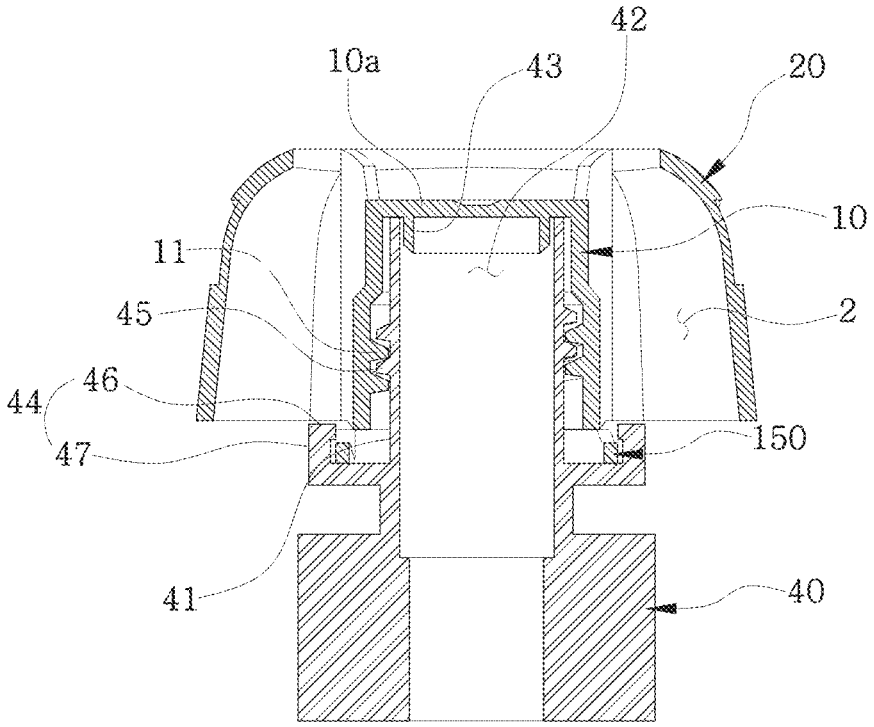
FIG. 12 is a sectional view of FIG. 10.
Figure 13:
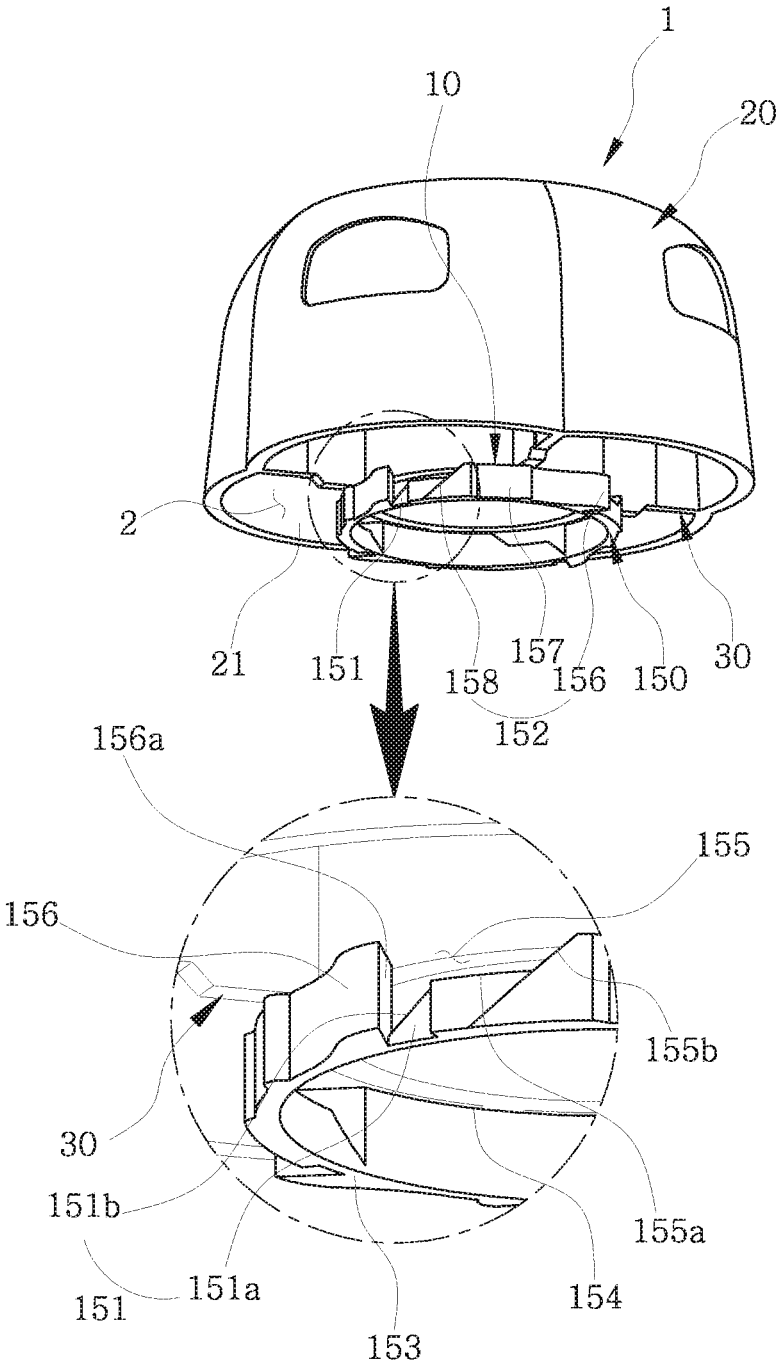
FIGS. 13 and 14 are perspective views showing the safety cap according to the second embodiment of the present invention and each of the figures includes an enlarged view of a section thereof.
Figure 14:
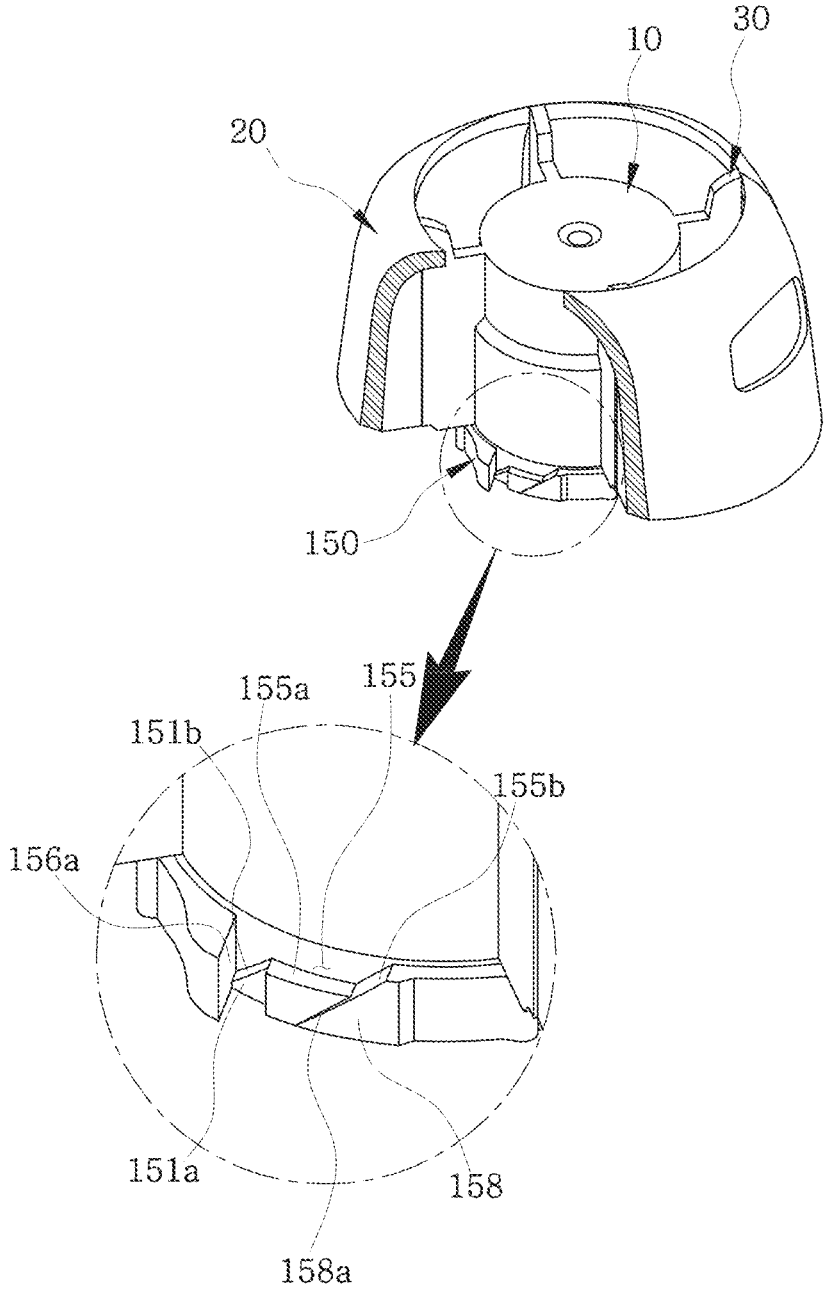
Figure 15A:
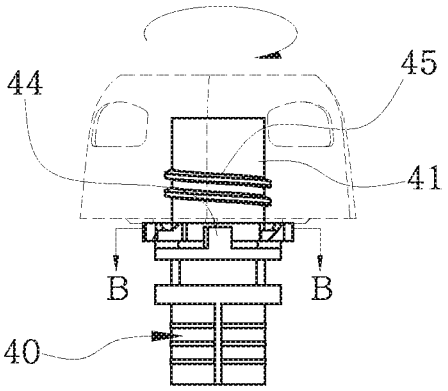
FIGS. 15A, 15B, 15C, 15D, 15E, 15F, 16A, 16B and 16C are views showing operational states of the safety cap according to the second embodiment of the present invention.
Figure 15B:
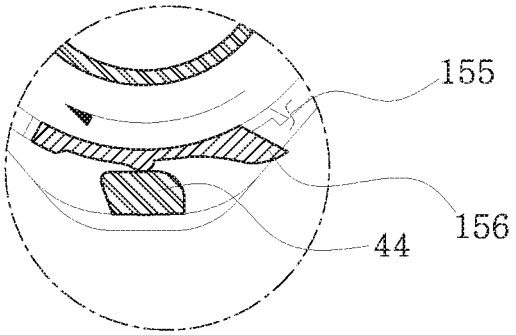
Figure 15D:
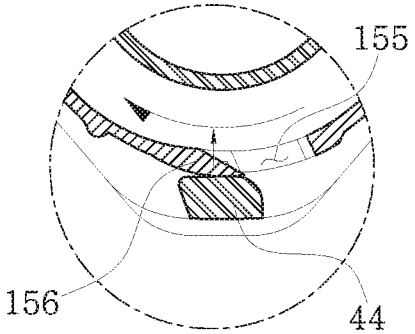
Figure 15C:
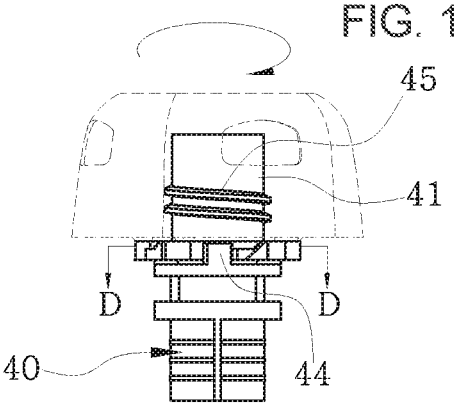
Figure 15E:
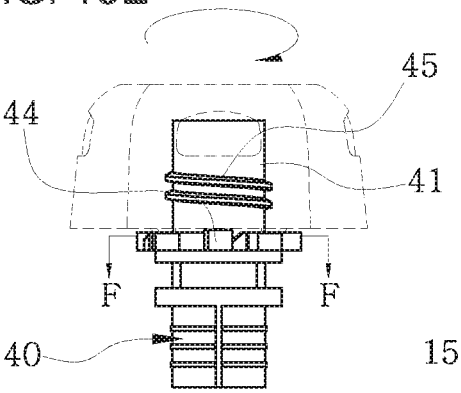
Figure 15F:
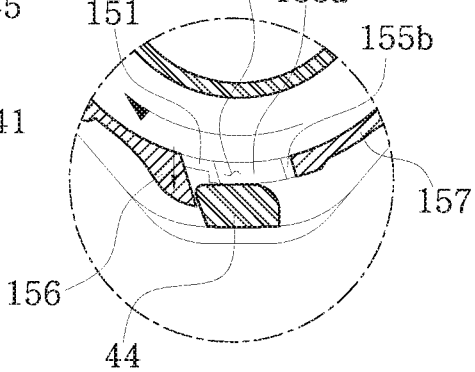
Figure 16A:
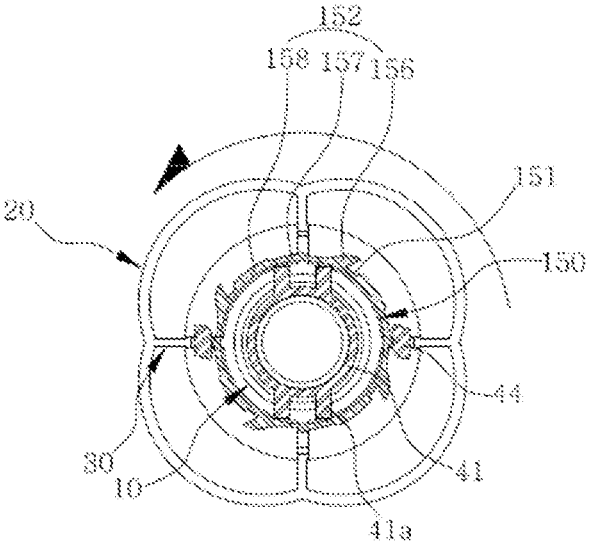
Figure 16B:
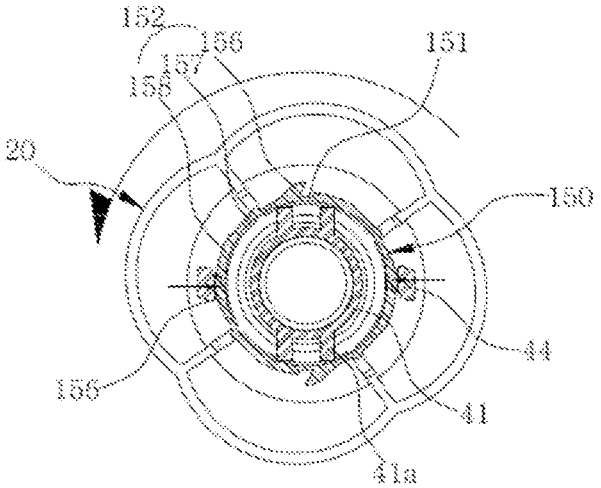
Figure 16C:
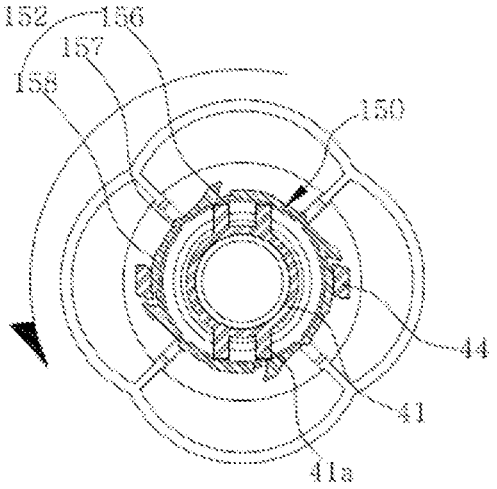
Figure 17:
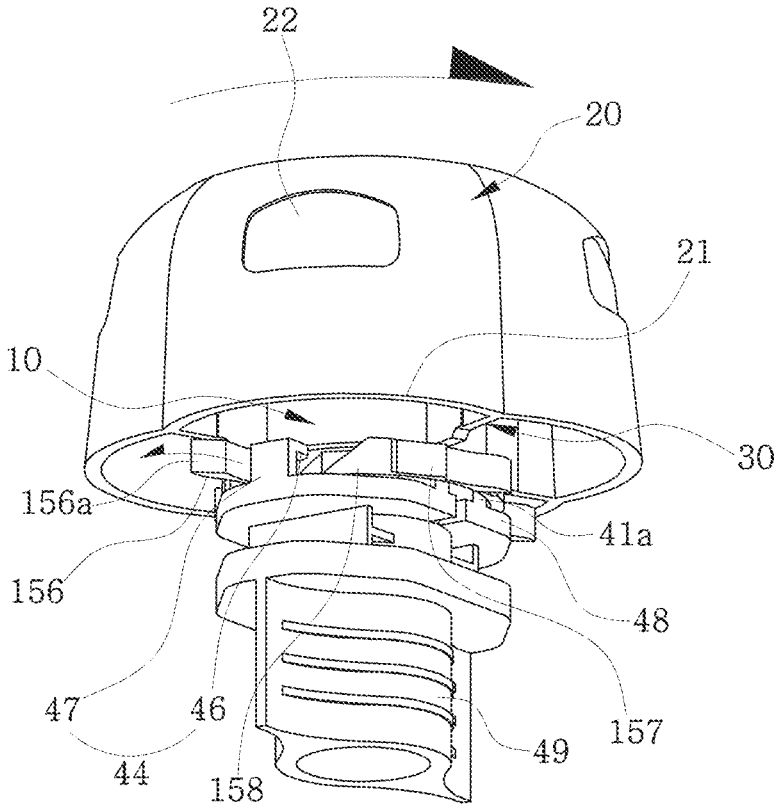
FIG. 17 is a perspective view showing a state in which the safety cap is opened according to the second embodiment of the present invention.
Figure 18A:
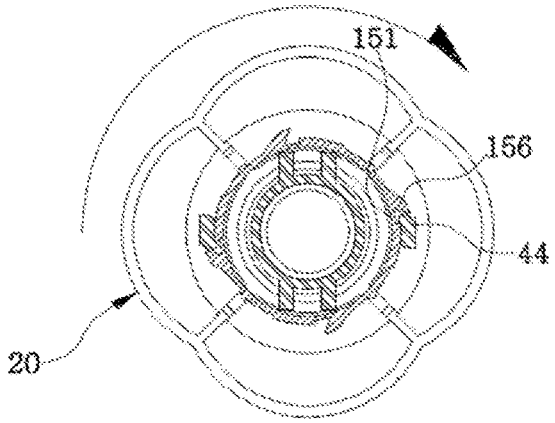
FIGS. 18A, 18B, and 18C are views showing an operational state of the safety cap being opened according to the second embodiment of the present invention.
Figure 18B:
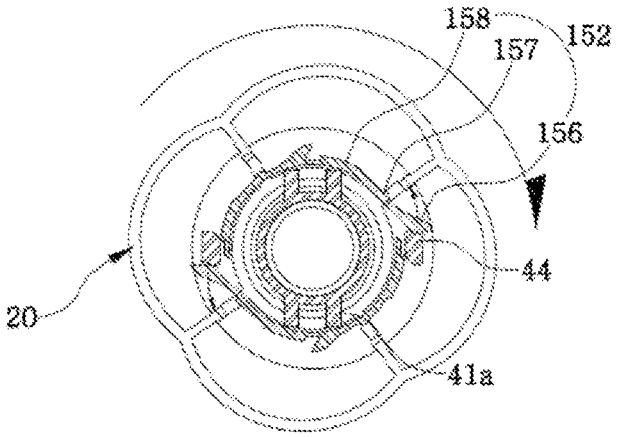
Figure 18C:
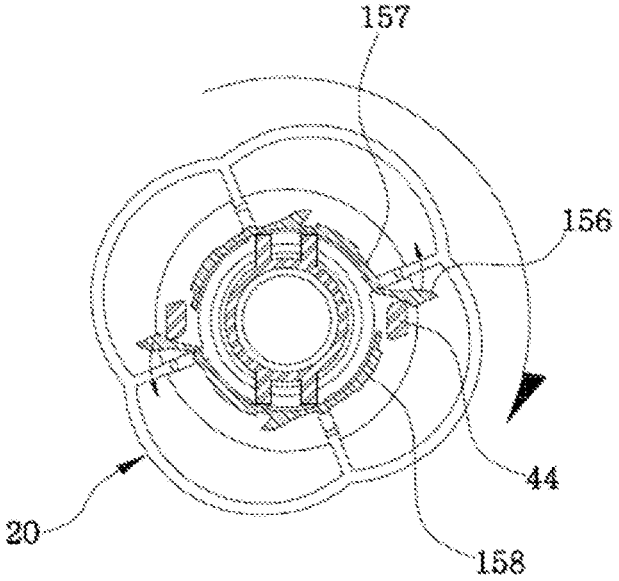
Figure 19:
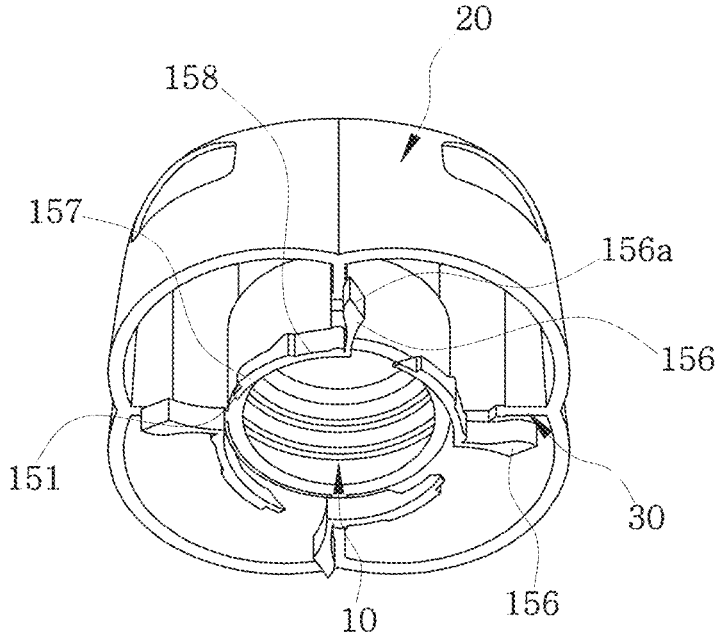
FIG. 19 is a perspective view showing the opened safety cap according to the second embodiment of the present invention.

In addition, FIGS. 10 to 18C show a safety cap spout according to a second embodiment of the present invention. FIG. 15A is a side view of the body 40 and the latching protrusion 44 as the cap (e.g., cap 10), shown in dashed lines, is starting to be rotated clockwise. FIG. 15B is a magnified partial cross-sectional view taken along line B-B of FIG. 15A, FIG. 15C is a view similar to FIG. 15A as the cap (e.g., cap 10), shown in dashed lines, is rotated clockwise, and FIG. 15D is a magnified partial cross-sectional view taken along line D-D of FIG. 15C, FIG. 15E is a view similar to FIG. 15C as the cap (e.g.,cap 10), shown in dashed lines, is further rotated clockwise, and FIG. 15F is a magnified partial cross-sectional view taken along line F-F of FIG. 15E.

In this case, a guarantee seal 150 having a shape of a circular band that has an inner diameter relatively larger than an outer diameter of the inner cap 10 is provided at a lower end of the inner cap 10.

In the guarantee seal 150, curved cut-out parts 152 provided at lower ends of the tabs 30 are connected to each other by weak parts 151, a lower rim 153 having a shape of a circular band is formed at a bottom of the guarantee seal 150, and an upper rim 154 having a plurality of latching grooves 155 is formed at a top of the guarantee seal 150.

The guarantee seal 150 is provided to notify that the guarantee seal 150 is broken by the cut-out part 152 being released outwards as the weak part 151 is broken by the latching protrusion 44.

In detail, the cut-out part 152 is coupled to one end of the weak part 151 at one side of a curved part 157 coupled to the tab 30 through a connection part 158, which is relatively thicker than the curved part 157, so that the weak part 151 can be supported so as not to be easily broken when the cap is fastened to the body 40.

Further, the curved part 157 is provided at an opposite side thereof with a latching sill 156, which slantingly protrudes outwards and has a gripping surface 156*a* relatively larger than an outer side surface 151*a* of the weak part 151, a lower end of the gripping surface 156*a* is coupled to an opposite end of the weak part 151, and the latching sill 156 is flexibly released and fastened to cover an outside of the weak part 151.

Therefore, when the cap is fastened to the body, even if the gripping surface 156*a* makes contact with the outer side surface 151*a* of the weak part 151 as the outside of the latching sill 156 is pressed and flexibly fastened by the latching protrusion 144, the latching protrusion 44 located at the outside is guided to move directly into the latching groove 155 while the gripping surface 156*a* formed to be larger the weak part 151 covers the weak part 151.

The latching groove 155 opened laterally is formed with: a seating surface 155*a* on which the latching hook 46 is seated and which is positioned on one upper side of the weak part 151 having an upper portion which is incised; and an inclined surface 155*b* that connects the upper rim 154 to the lower rim 153.

Further, the upper rim 154 and the lower rim 153 having mutually different thicknesses are arranged at a lower portion of the latching groove 155 to form an inclined sill 158*a* at an outer side of the connection part 158, and the inclined sill 158*a* guides the latching protrusion 44 to slide on an outside of the guarantee seal 150 and move inward of the latching groove 155.

In addition, the weak part 151 is formed stepwise at one end of the connection part 158 with a thickness relatively thinner than the cut-out part 152 to form an outer side surface 151*a*, which is recessed inwards, and the outer side surface 151*a* has an area relatively smaller than the gripping surface 156*a* of the latching sill to minimize a region to be broken, such that even if the latching sill 156 is flexibly fastened when the cap is fastened to the body, the outer side surface 151*a* of the weak part 151 is covered by the gripping surface 156*a* of the latching sill 156 and prevented from being broken.

Further, the weak part 151 is connected by an incision surface 151*b* inclined from the connection part 158 to the latching sill 156 so as to be easily cut off by the latching protrusion 44 when the outer cap is rotated reversely.

In addition, the latching protrusion 44 protrudes from the top surface of the latching flange 48 of the body where the straw 41 is provided. According to an embodiment, the straw 41 includes a plurality of supports 41*a* that protrude while forming a diameter smaller than a diameter of the guarantee seal. When the straw 41 is coupled to the threaded part 11 of the inner cap 10 and locked, the latching protrusion 44 provided on the latching flange 48 of the body 40 presses the outside of the guarantee seal and is inserted into the latching groove, and the support 41*a* provided at an edge of the straw 41 supports the guarantee seal 150 from an inside.

In addition, the latching protrusion 44 has an upright shaft 47 protruding upwards, and a latching hook 46 protruding from an upper portion of the upright shaft while being bent inwards.

At this time, when the safety cap is reversely rotated so as to be opened as shown in FIGS. 16A to 18C, the latching protrusion 44 located inside the latching groove 155 makes contact with the gripping surface 156*a* of the latching sill 156, and the latching protrusion 44 pushes the latching sill 156 outwards, so that the weak part 151 provided between the latching sill 156 and the connection part 158 is cut off.

At this time, the cut-out part 152 having the latching sill 156 is coupled to the tab 30, and the cut-out part 152 is released to the outside of the inner cap 10 by the latching protrusion 44 by a length of a curved portion from the latching sill 156 to the tab 30, so that the guarantee seal 150 is accurately cut and a cut-off state is exposed to the outside so as to achieve the accurate opening and easy recognition.

For reference, the annular wall part 21 of the outer cap 20 extends around the central axis X, for example, from the inner cap while continuously and annularly surrounding the inner cap 10. Preferably, the annular wall part 21 is a grip portion of the cap 1, that is, a portion to be gripped by a user to screw-tighten or screw-loosen the cap 1 from the pouch-type container 100.

Preferably, the annular wall part 21 has a cap-shape tapered upwards at a portion where the guarantee seal 150 is located.

Even more preferably, a lower rim of the annular wall part 21 is curved upwards and consecutively extends with a predetermined width while forming gaps therein at predetermined intervals, so that if a child swallows the cap 1 carelessly or accidentally, the cap 1 may not block the airway regardless of the directionality of the cap 1.

The bending of the annular wall part makes the gripping easy. In addition, another way of preventing the airway from being blocked is to form openings in the annular wall part at predetermined intervals, which may have the same effect as well.

While the present disclosure has been shown and described with reference to various embodiments thereof, it will be understood by those skilled in the art that various changes in form and details may be made therein without departing from the spirit and scope of the present disclosure as defined by the appended claims and their equivalents.

What is claimed is:

1. A combination of a safety cap and a body, the safety cap comprising:

an inner cap having a closed top, the inner cap being detachably couplable to a body;

an outer cap provided outside the inner cap;

a plurality of tabs for coupling the inner cap to the outer cap;

a vent hole formed between the inner cap and the outer cap; and a guarantee seal provided at a lower end of the inner cap and coupled to the plurality of tabs, the guarantee seal configured to break upon opening of the safety cap, wherein, the guarantee seal includes:

a plurality of curved cut-out parts provided at lower ends of the plurality of tabs, a plurality of weak parts, each of the plurality of weak parts connected to two adjacent curved cut-out parts among the plurality of curved cut-out parts, a lower rim shaped as a circular band, the lower rim formed at a bottom of the guarantee seal, and an upper rim having a plurality of latching grooves, the upper rim being formed at a top of the guarantee seal;

wherein the body includes:

a straw, a latching flange configured to engage the guarantee seal, and a latching protrusion including a latching hook, the latching protrusion provided at an edge of a top surface of the latching flange; and wherein, when the inner cap is screw-coupled to the straw of the body, the latching hook of the latching protrusion is inserted into one of the plurality of latching grooves of the upper rim to be latched to the one of the plurality of latching grooves.

2. The combination of claim 1, wherein each of the plurality of curved cut-out parts is provided with a curved part located at the lower end of a respective tab of the plurality of tabs, wherein one of the plurality of curved cut-out parts is coupled to one end of one of the plurality of weak parts, and wherein the one of the plurality of curved cut-out parts is provided at an opposite side of the coupling with a latching sill that slantingly protrudes outwards, the one of the plurality of curved cut-out parts includes a gripping surface larger than an outer side surface of the one of the plurality of weak parts.

3. The combination of claim 1, wherein at least one of the plurality of latching grooves includes:

a seating surface on which the latching hook is seated, the seating surface positioned on a top of a connection part, the seating surface connected to one of the plurality of weak parts; and an inclined surface that connects the upper rim to the lower rim.

4. The combination of claim 3, wherein the upper rim and the lower rim have mutually different thicknesses and are arranged to form an inclined sill at an outer side of the connection part, and wherein the inclined sill guides the latching protrusion to move inward of the one of the plurality of latching grooves.

5. The combination of claim 2, wherein at least one of the plurality of weak parts is formed with a thickness relatively thinner than the plurality of curved cut-out parts to form the outer side surface that is recessed inwards, and wherein the outer side surface includes an area relatively smaller than the gripping surface of the latching sill to minimize a region to be broken, such that the latching sill is flexibly fastened when the inner cap is fastened to the body.

6. The combination of claim 1, wherein a plurality of supports are provided at the straw of the body, and wherein, when the inner cap is screw-coupled to the straw and locked, the latching protrusion presses an outside of the guarantee seal and is inserted into the one of the plurality of latching grooves, and the plurality of supports provided at an edge of the straw support the guarantee seal from an inside.

7. The combination of claim 1, further comprising:

a concave groove formed in an annular wall part of the outer cap to allow the outer cap to be rotated by gripping the concave groove with a finger.

* * * * *